US005953556A

United States Patent [19]

Yamanaka

[11] Patent Number: 5,953,556

[45] Date of Patent: Sep. 14, 1999

[54] ELECTROPHOTOGRAPHIC RECORDING APPARATUS WITH TRANSFER VOLTAGE TRACKING

[75] Inventor: Shuichi Yamanaka, Tokyo, Japan

[73] Assignee: Oki Data Corporation, Tokyo, Japan

[21] Appl. No.: 09/129,501

[22] Filed: Aug. 5, 1998

[30] Foreign Application Priority Data

Aug. 13, 1997 [JP] Japan ..... 9-233379

[51] Int. Cl.[6] ..... G03G 15/00; G03G 15/16

[52] U.S. Cl. ..... 399/66

[58] Field of Search ..... 399/45, 66, 314, 399/313

[56] References Cited

U.S. PATENT DOCUMENTS 5,682,575 10/1997 Komori ..... 399/66

5,722,010 2/1998 Okubo et al. .

*Primary Examiner*—Joan Pendegrass

*Attorney, Agent, or Firm*—Akin, Gump, Strauss, Hauer & Feld, L.L.P.

[57] ABSTRACT

An electrophotographic printer improves a transfer operation. A toner image is formed on the photoconductive drum in accordance with dot data. When a print medium passes between the transfer roller and the photoconductive drum, the toner image is transferred to the print medium with the aid of Coulomb force. The controller calculates a resistance of a circuit on the basis of the transfer voltage and the transfer current, the circuit including the photoconductive drum, transfer roller, and the print medium sandwiched between the photoconductive drum and transfer roller. The controller causes the high voltage power supply circuit to output the transfer voltage having an optimum in value for the print medium in accordance with the resistance.

3 Claims, 12 Drawing Sheets

ELECTROPHOTOGRAPHIC RECORDING APPARATUS WITH TRANSFER VOLTAGE TRACKING

BACKGROUND OF THE INVENTION

1. Field of the Invention

The present invention relates to an electrophotographic recording apparatus with an improved measurement of a resistance of a circuit including a photoconductive drum, transfer roller, and a print medium sandwiched between the photoconductive drum and the transfer roller. The improved measurement of the resistance provides an optimum transfer voltage.

2. Description of the Related Art

In electrophotographic printers, the surface of a photoconductive drum is charged and the charged surface is then exposed to a print image. The print image forms an electrostatic latent image on the charged surface. The electrostatic latent image is developed with a toner into a toner image which in turn is transferred by a transfer roller to a print medium such as paper. The transferred toner image is subsequently fused. The transfer roller receives a transfer voltage from a high voltage power supply circuit and produces a Coulomb force which transfers the toner image to the print medium. The transfer efficiency depends on the conditions such as the size and thickness of the print medium and environment humidity and temperature. Therefore, when the print medium has been pulled in between the transfer roller and the photoconductive drum, the electrical resistance of a circuit including the print medium is measured so that the high voltage power supply circuit outputs a high voltage to run an optimum transfer current in accordance with the the resistance of the print medium.

The aforementioned conventional art suffers from the following drawbacks. The print medium is pulled in between the transfer roller and the photoconductive drum, and passes a transfer point where the print medium is sandwiched between the transfer roller and the photoconductive drum. The leading end portion of the print medium which is commonly referred to as "top margin" is subjected to a measurement of electrical resistance of the print medium. This area is outside of a print area of the print medium and usually lies over a very short distance in the direction of travel of the print medium. Therefore, when the print medium travels fast, i.e., a printing is performed at a high speed, the top margin passes the transfer point too soon before the voltage applied to the print medium and the current through the print medium become stable. In other words, after the application of a voltage to the print medium, the current flowing through the print medium requires some time before it reaches a stable value due to static capacitances of various parts. In order to address this drawback, one method has been developed in which a true value is determined by calculation based on an actually measured value. However, the actual resistance of the print medium is greatly affected by the electrical resistance values of the photoconductive drum and print medium, or static capacitance values. Combinations of these physical quantities further dictate the measurement of resistance of the print medium. Thus, a simple calculation does not provide a sufficiently accurate result but causes large errors.

SUMMARY OF THE INVENTION

The present invention is to solve the aforementioned drawbacks of the conventional electrophotographic printers.

An object of the invention is to provide an electrophotographic printer where a resistance of the circuit including the photoconductive drum, transfer roller, and the print medium can be determined as accurately as possible.

An object of the invention is to provide an electrophotographic printer where a transfer voltage is determined in accordance with the resistance.

An electrophotographic printer has a photoconductive drum, high voltage power supply circuit, detector, transfer roller, and controller.

As the photoconductive drum rotates, a toner image is formed on the photoconductive drum in accordance with dot data. The transfer roller rotates in a direction opposite to the direction in which the photoconductive drum rotates. The high voltage power supply circuit outputs a transfer voltage and a transfer current to the transfer roller and the detector detects the transfer voltage and the transfer current. When a print medium passes a transfer point where the print medium is sandwiched between the transfer roller and the photoconductive drum, the transfer roller transfers the toner image from the photoconductive drum to the print medium with the aid of the transfer voltage and transfer current. The controller calculates a resistance of a circuit including the photoconductive drum, transfer roller, and the print medium sandwiched between the photoconductive drum and transfer roller, the resistance being calculated on the basis of the transfer voltage and the transfer current. The controller causes the high voltage power supply circuit to output the transfer voltage in accordance with the resistance, the transfer voltage having an optimum value for the print medium.

The controller may search the dot data for a first dot which should be printed, thereby determining a non-print region which lies from a leading end of the print medium to a beginning of the toner image. Then, the controller calculates the resistance immediately before the non-print region has passed the transfer point.

After the high voltage power supply circuit has output a transfer voltage of a predetermined value to the transfer roller, the controller may calculate the electrical resistance of the circuit at predetermined intervals while the first page is passing the transfer point and then calculates an average value of the resistance values. The controller then adjusts the transfer voltage to an optimum value in accordance with the average value of the electrical resistance of the circuit. This way of operation is particularly advantageous if a plurality of pages are to be printed consecutively, since the transfer voltage for the second page onward is optimized. A resistance value may be discarded if a difference between the resistance value and an average value of previously measured resistance values falls outside of a predetermined range.

The toner image is formed on the photoconductive drum in accordance with the dot data on a line by line basis. The controller searches dot data for a dot on a line-by-line basis, and calculates the resistance if the dot is absent in lines in excess of a predetermined number are detected, the resistance being calculated when an area on the photoconductive drum defined by the lines passes the transfer point.

Further a scope of applicability of the present invention will become apparent from the detailed description given hereinafter. However, it should be understood that the detailed description and specific example, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Embodiments of the invention will be described in detail with reference to the accompanying drawings.

First embodiment

Figure 1:
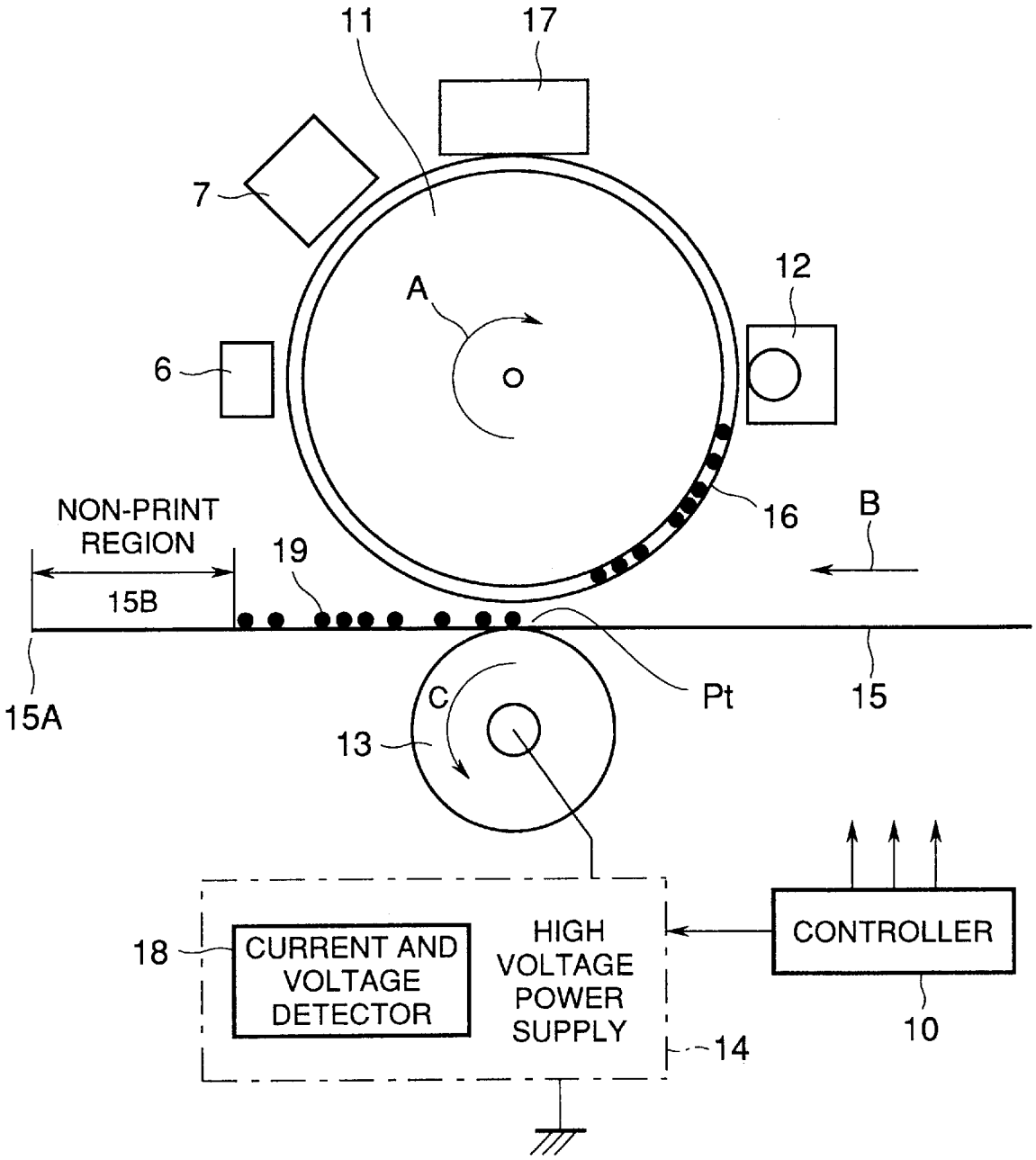
FIG. 1 illustrates a general construction of a printer according to the present invention.

FIG. 1 illustrates a general construction of a printer according to the present invention.

Referring to FIG. 1, a photoconductive drum 11 is located in the middle of FIG. 1. Disposed around the photoconductive drum 11 are a cleaner 6, a charging unit 7, an exposing unit 17, a developing unit 12, and a transfer roller 13, aligned in this order along the rotational direction of the photoconductive drum 11. The photoconductive drum 11 rotates in a direction shown by arrow A and the exposing unit 17 illuminates the surface of the photoconductive drum 11 to form an electrostatic latent image thereon. The developing unit 13 applies toner to the latent image to develop the latent image into a toner image 19. The transfer roller 13 is in contact with the photoconductive drum 11 and rotates in a direction shown by arrow C. The transfer roller 13 receives a transfer voltage from a high voltage power supply circuit 14. The print medium 15 travels in a direction shown by arrow B and is pulled in between the transfer roller 13 and the photoconductive drum 11. When the print medium 15 passes a transfer point Pt where the print medium 15 is sandwiched between the transfer roller 13 and the photoconductive drum 11, the toner image is transferred from the photoconductive drum 11 to the print medium 15. When the print medium 15 passes the transfer point Pt, a detector 18 detects a transfer voltage supplied to the transfer roller 13 and a transfer current flowing through the print medium 15 via the transfer roller 13 and the photoconductive drum 11. On the transfer voltage and transfer current, the controller 10 calculates a resistance of the circuit including the photoconductive drum 11, transfer roller 13, and the print medium 15.

Figure 2:
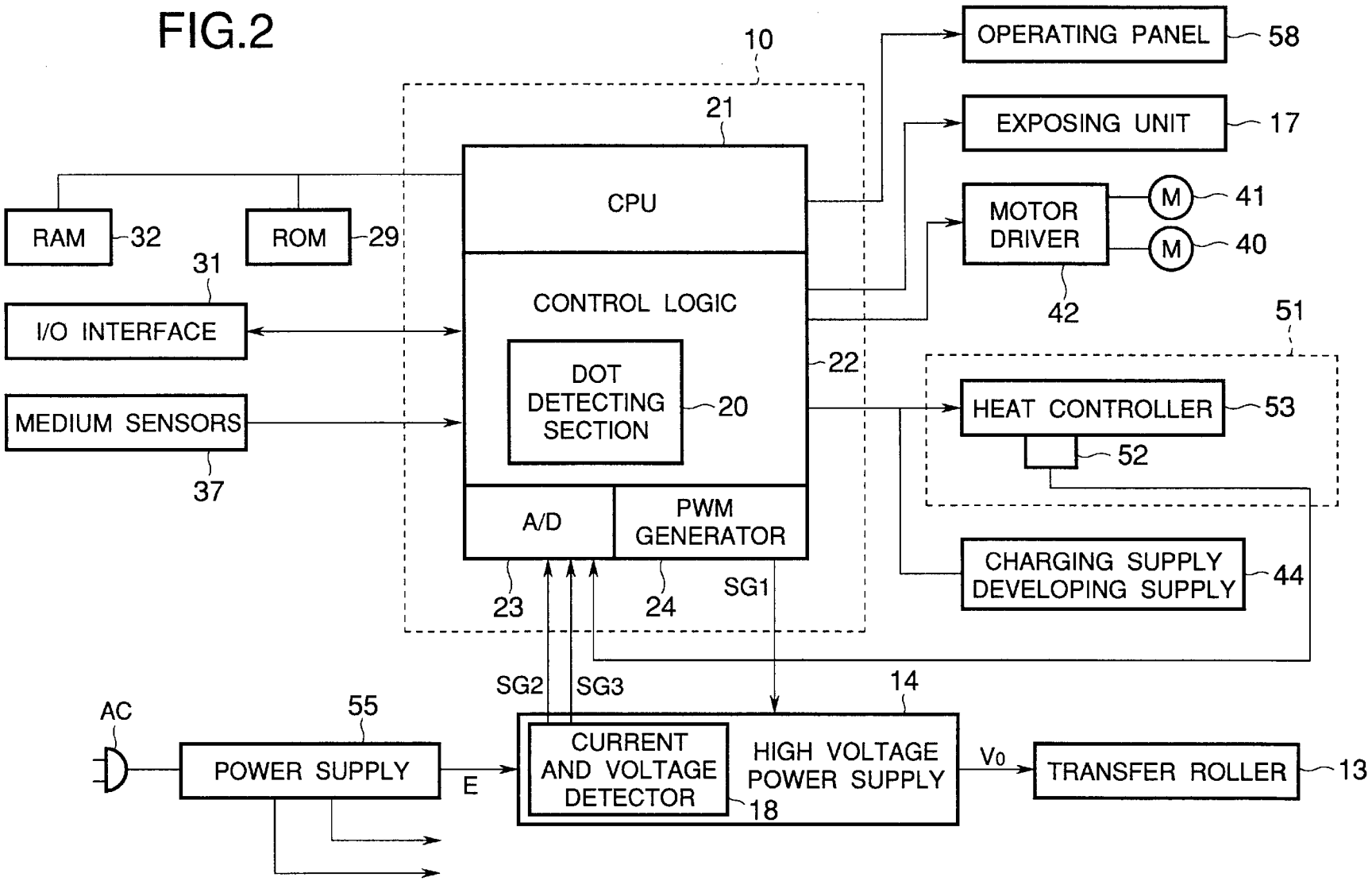
FIG. 2 is a block diagram of the printer according to the present invention.

FIG. 2 is a block diagram of an electrophotographic printer according to the present invention.

A controller 10 controls the overall operation of the printer. The controller 10 includes a CPU (central processing unit) 21, control logic 22, A/D converter 23, and PWM (pulse-width modulated) signal generator 24. These are in the form of a one-chip LSI fabricated on a single semiconductor wafer. In addition to the controller 10, the printer includes a ROM 29, RAM 32, input/output interface 31, print medium sensors 37, operating panel 58, exposing unit 17, motor driver 42, fixing unit 51, charging and developing power supply circuit 44, and high voltage power supply circuit 14.

The ROM 29 is a memory which stores programs for the controller 10 to operate. The RAM 32 is a memory which stores various parameters for controlling the printing operation. The input/output interface 31 is a circuit via which print data is received from a host apparatus such as a personal computer, not shown, and output to the control logic 22. The print medium sensors 37 supply the control logic 22 with the information as to whether the print medium is present or absent in the transport path and information on the positions of the medium being transported. The user inputs, for example, printing conditions by operating keys on the operating panel 58.

The controller 10 generates dot data on the basis of the print data received via the I/O interface and supplies the dot data to the exposing unit via the logic control 22. The exposing unit 17 illuminates the photoconductive drum 11, not shown, in accordance with the dot data, thereby forming an electrostatic latent image on the surface of the photoconductive drum 11. The motor driver 42 drives a drum motor 41 and a paper feeding motor 40 in rotation under the control of the control logic 22 at predetermined timings, thereby controlling the travel and positions of the print medium 15 along the transport path. The fixing unit 51 has a heat controller 53 and heats the print medium 15 having a toner image transferred thereon to fuse the toner. The fixing unit 51 has a thermistor 52 for detecting the temperatures of the heat controller 53. The A/D converter 23 receives the output of the thermistor 52 and converts it into a digital signal. The control logic 22 produces a control signal based on this digital signal and outputs the control signal to the heat roller 53, thereby controlling the temperature of the heat roller 53 toward a predetermined setting.

The charging/developing power supply 44 supplies predetermined voltages to the charging unit 7 and developing unit 12. The high voltage power supply circuit 14 supplies a necessary transfer voltage Vo to the transfer roller 13. The current/voltage detector 18 in the high voltage power supply circuit 14 detects a transfer current and a transfer voltage supplied from the high voltage power supply circuit 14 to the transfer roller 13 and the print medium 15. The A/D converter 23 receives output-current detection signal SG2 and output-voltage detection signal SG3, indicative of the transfer current and transfer voltage, respectively, from the high voltage power supply circuit 14, and converts the detection signals SG2 and SG3 into digital signals. The digital signals are sent to the control logic 22. A resistance of the circuit including the photoconductive drum 11, print medium 15, and transfer roller 13 is calculated on the basis of the detection signals SG2 and SG3.

The PWM signal generator 24 generates a PWM signal SG1 on the basis of the resistance of the circuit supplied from the control logic 22. The PWM signal SG1 indicates an optimum output voltage of the high voltage power supply circuit 14. Then, the PWM signal generator 24 supplies the PWM signal SG1 to the high voltage power supply circuit 14 in order to control the high voltage power supply circuit 14 to output the optimum voltage.

The power supply circuit 55 receives a commercial electric power AC and supplies a drive power to the various parts of the printer.

The controller 10 receives print data via the input/output interface 31 from the host computer, and temporarily stores the print data in the RAM 32. The print data stored in the RAM 32 is converted into dot data based on the information stored in the ROM 29, and is again stored into a predetermined memory area in the RAM 32. The dot data is then output to the exposing unit 17 at predetermined timings. The exposing unit 17 has an LED array, not shown, which illuminates the outer circumferential surface of the photoconductive drum 11 to form an electrostatic latent image thereon in accordance with the dot data.

The print medium sensors 37 shown in FIG. 2 include sensors provided at various locations along the transport path of the print medium 15. The sensors detect, for example, the various locations of the print medium 15 being fed from a paper cassette, not shown, traveling along the transport path, and being discharged from the paper exit. The sensor also detects the width of the print medium 15. The controller 10 receives the detection signals from these sensors 37 and causes the feed motor 40 to draw the print medium 15 from the paper cassette. Then, the print medium 15 is transported in a direction shown by arrow B as shown FIG. 1.

The cleaner 6 cleans the surface of the photoconductive drum 11 after the transfer operation and subsequently the photoconductive drum 11 is charged by the charging unit 7 to a predetermined potential.

Figure 3:
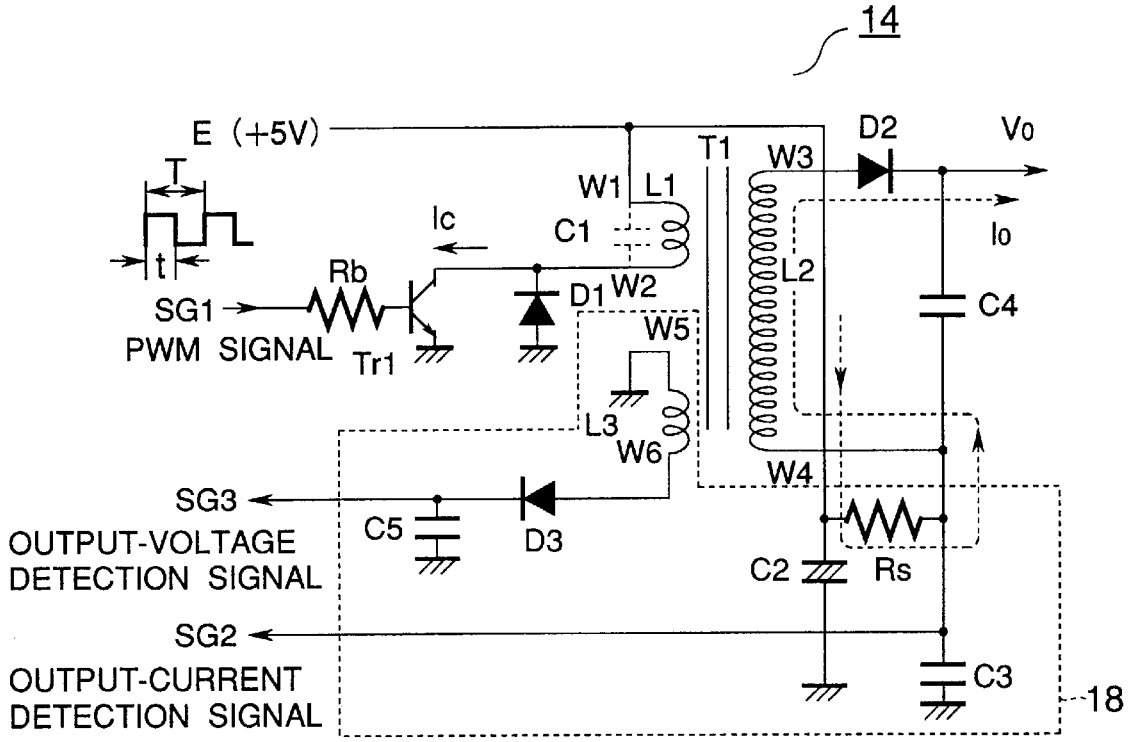
FIG. 3 is a schematic diagram of the high voltage power supply circuit of the present invention.

FIG. 3 is a schematic diagram of the high voltage power supply circuit 14.

The circuit receives a drive voltage E of 5 V from the power supply circuit 55 shown in FIG. 2. A transformer T1 has a primary winding L1 to which the drive voltage E is supplied, a secondary winding L2 that is greater in the number of turns than the primary winding L1, and a tertiary winding L3. The secondary winding L2 provides a high voltage which is supplied to the transfer roller 13.

The primary winding L1 has a stray capacitance C1 in parallel with the primary winding L1. The primary winding L1 and the stray capacitance C1 form a resonance circuit. The primary winding L1 has its one end w2 connected to the cathode of a diode D1 and the collector of a transistor Tr1. The diode D1 has its anode connected to the ground. The transistor Tr1 has its emitter connected to the ground. A pulse-width modulated signal SG1 is fed to the base of the transistor Tr1 via a resistor Rb. The secondary winding L2 has one end w3 connected to the anode of a rectifying diode D2 and the other end w4 connected to a noise filter capacitor C3. The other end of the capacitor C3 is grounded. A smoothing capacitor C4 is connected between the end w4 of the second winding L2 and the cathode of the diode D2.

A current detecting resistor Rs is connected between the drive voltage E and the end w4 of the secondary winding L2, and a decoupling capacitor C2 is between the drive voltage E and the ground. One end w5 of the tertiary winding L3 is grounded and the other end w6 is connected to the anode of a rectifying diode D3. The tertiary winding L3 serves as a sensor coil that detects the output voltage Vo of the high voltage power supply circuit 14. A smoothing capacitor C5 is connected between the cathode of the diode D3 and the ground. The voltage across the capacitor C5 is proportional to the output voltage Vo and is used as an output-voltage detection signal SG3.

The operation of the circuit in FIG. 3 will now be described.

The base of the transistor Tr1 receives the PWM signal SG1 via the resistor Rb. The resistor Rb limits the base current flowing into the transistor Tr1. The PWM signal SG1 has a predetermined period T. Within the same period T, the ON time t is controlled so that the ON time will be longer when the output voltage Vo should higher, and shorter when the output voltage should be lower. When the transistor Tr1 is driven by the PWM signal SG1 to cycle on and off, an oscillatory current flows through the primary winding L1 of the transformer T1.

The voltage appearing across the secondary winding L2 is a voltage stepped up by the ratio in the number of turns of the primary winding L1 to the secondary winding L2. The current flowing through the secondary winding L2 is rectified by the diode D2 and smoothed out by the capacitor C4 into an output voltage Vo, which is then supplied to the transfer roller 13. The output current Io supplied to the transfer roller 13 flows through the current detecting resistor Rs. Thus, the voltage on the capacitor C3 is equal to E–Io*Rs, which is output as an output-current detection signal SG2.

Figure 4:
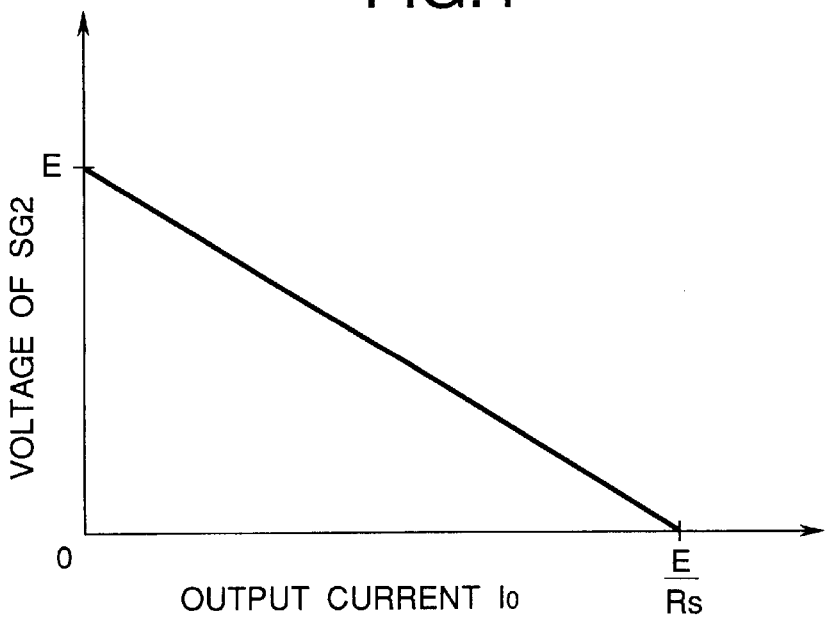
FIG. 4 illustrates the relationship between the output current and the voltage of the output-current detection signal of the circuit of FIG. 3.

FIG. 4 illustrates the relationship between the output current Io and the voltage of the output-current detection signal SG2. When no output current Io is drawn from the high voltage power supply circuit 14, the voltage of SG2 is equal to E. The voltage of SG2 decreases with increasing output current Io, reaching E/Rs at which the SG2 becomes zero volts. The A/D converter 23 converts the output-voltage detection signal SG3 into a digital signal proportional to the output-voltage detection signal SG3. The controller 10 produces a necessary PWM signal SG1 in accordance with the output of the A/D converter 23, and then outputs the PWM signal SG1 to the high voltage power supply circuit 14. The high voltage power supply circuit 14 then controls the output voltage Vo in accordance with the PWM signal SG1, thereby providing an optimum transfer voltage.

The tertiary winding L3, capacitors C2, C3, C5, diode D3, and resistor Rs form a detector 18 shown in FIG. 1. The detector 18 operates to detect the output voltage Vo and output current Io, so that the controller 10 determines an electrical resistance of a circuit including the photoconductive drum 11, transfer roller 13, and print medium 15.

Figure 5:
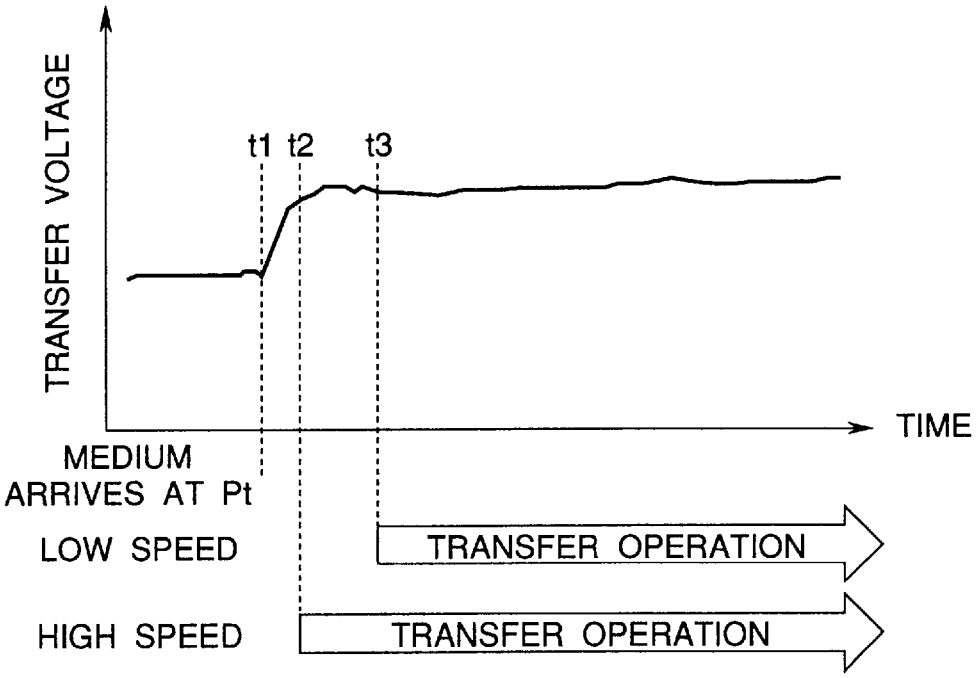
FIG. 5 illustrates the transfer voltage when the resistance of the print medium is relatively low.
Figure 6:
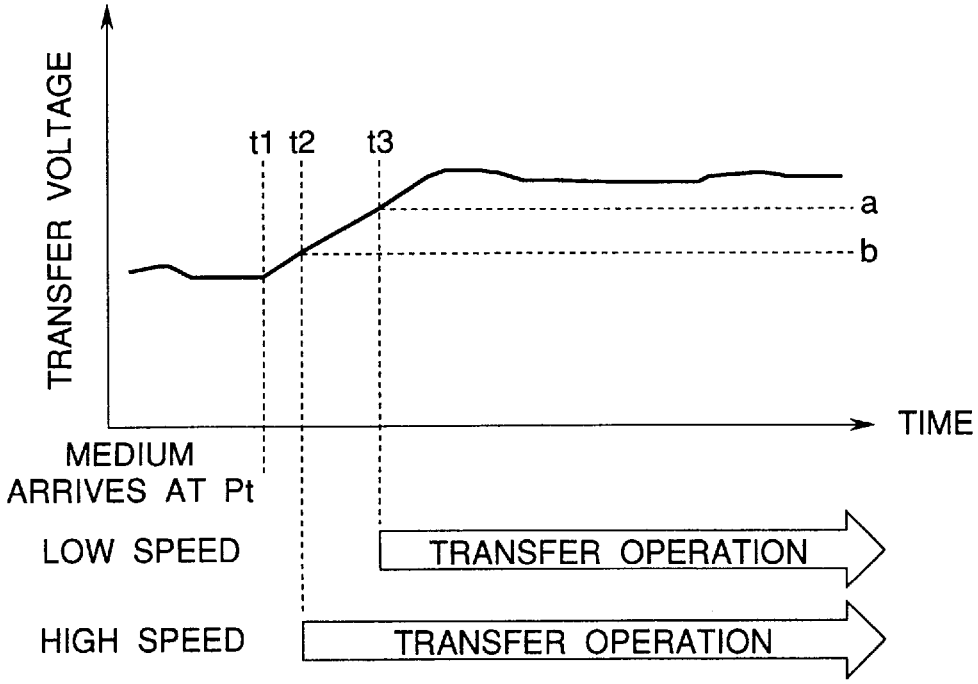
FIG. 6 illustrates the transfer voltage when the resistance of the print medium 15 is relatively high or the circuit capacitance is very large.

FIGS. 5 and 6 illustrate transfer voltages during transfer operation. FIGS. 5 and 6 plot time as the abscissa and transfer voltages as the ordinate.

Before a transfer operation takes place, the controller 10 controls the high voltage power supply circuit 14 to operate in a constant current control mode (referred to as CCC mode hereinafter) where a constant current is supplied to the transfer roller 13. The leading end of the print medium 15 arrives at the transfer point Pt at time t1 and is pulled in between the transfer roller 13 and the photoconductive drum 11, so that the resistance of the print medium 15 becomes in series with the transfer roller 13 and photoconductive drum 11 to increase the total resistance. Thus, the high voltage power supply circuit 14 operates to increase the output voltage (i.e., transfer voltage) in order to maintain the same output current (i.e., transfer current). The output current gradually increases due to the time constant of the circuit, finally reaching the previous value. Then, the controller 10 calculates the total resistance after the output current has become stable and determines an optimum transfer voltage in accordance with the total resistance. Thereafter, the controller 10 controls the high voltage power supply circuit to operate in a constant voltage control mode (referred to as CVC mode hereinafter) at time t3. If the optimum transfer voltage can be determined before the transfer operation of a toner image takes place, then transfer operation can be performed successfully.

FIG. 5 illustrates the transfer voltage when the resistance of the print medium 15 is relatively low.

The leading end of the print medium 15 arrives at the transfer point Pt at time t1. The top margin of the print medium 15 has passed the transfer point Pt at time t2 in a high speed printing operation and at time t3 in a low speed printing operation. Thus, the transfer operation is effected under substantially reasonable conditions.

If the print medium 15 has a relatively high resistance or the circuit capacitance is very large, the circuit response is very slow and the measurement of the total resistance of the circuit takes a longer time.

FIG. 6 illustrates the transfer voltage when the resistance of the print medium 15 is relatively high or the circuit capacitance is very large.

It takes a longer time to determine the total resistance of the circuit due to high resistance of the print medium and/or large capacitance in the circuit, so that the top margin of the print medium 15 will have passed too soon before the total resistance has been determined. Therefore, the print region of the print medium 15 will arrive at the transfer point Pt before the output current reaches the constant current value.

If the high voltage power supply circuit 14 enters the CVC mode at time t2 or time t3, immediately after the top margin has passed the transfer point Pt, then the output voltage is set to a voltage shown in dotted lines a or b, which is much lower than the optimum value shown in solid line. This is because the top margin is too short for the print medium 15 having a high resistance. Of course, it is possible to predict a stabilized transfer voltage by calculation but such a calculation is not accurate enough.

It should also be noted that the transfer operation of a toner image does not always take place immediately after the top margin has passed the transfer point Pt. There are cases where the beginning of a toner image appears beyond the top margin. In the present invention, the actual beginning of the toner image is detected on the basis of the dot data supplied to the exposing unit 17, thereby ensuring as large a non-print region as possible for more accurate measurement of the resistance of the print medium 15. In this specification, the term "non-print region" is used to cover an area in which a toner image is not printed. Thus, the non-print region includes an area from the leading end of the print medium 15 to the beginning of the toner image 19 and areas between adjacent paragraphs spaced apart from each other on a page of print medium. Thus, the non-print region includes the top margin.

Figure 7:
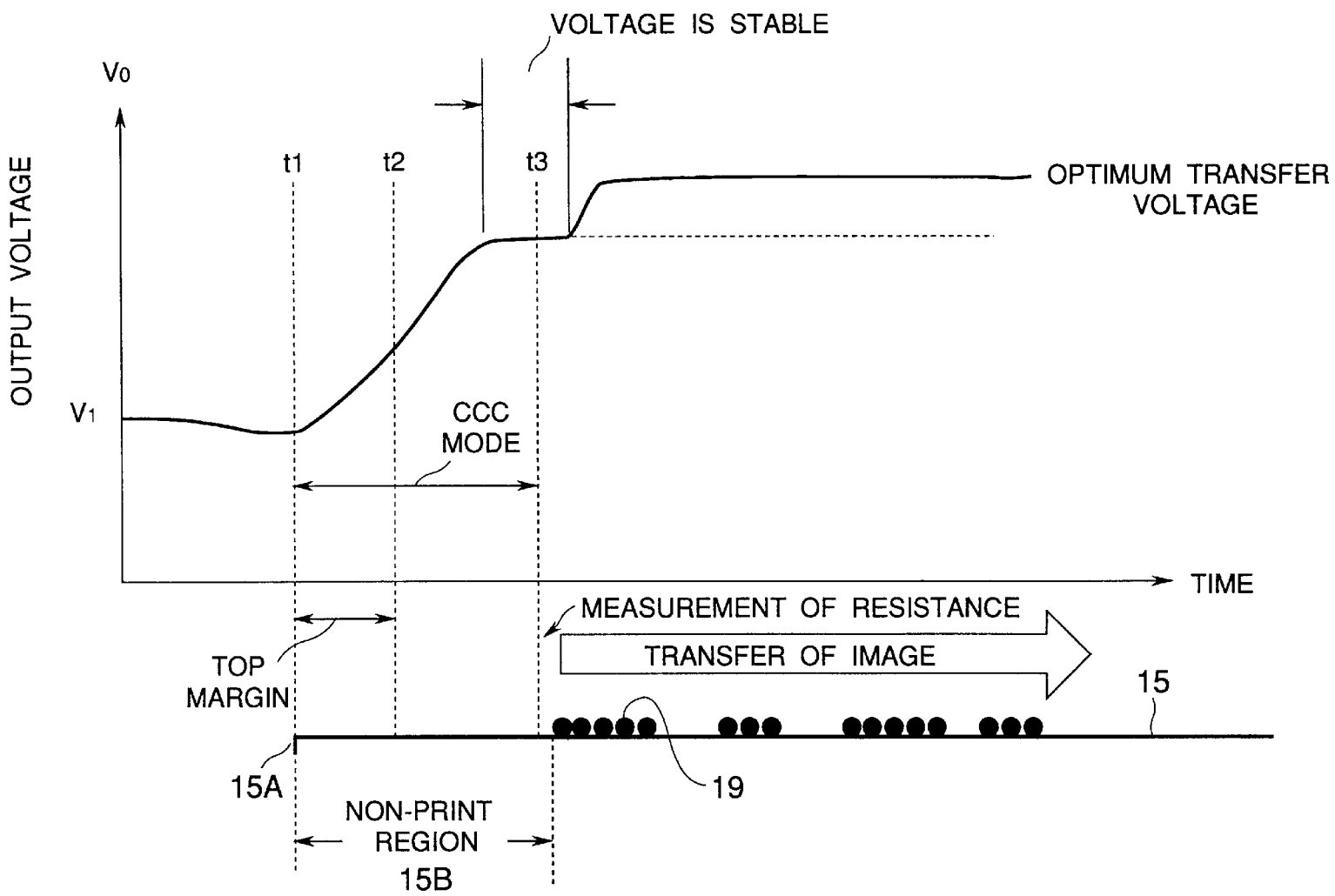
FIG. 7 is a timing chart of the printer according to the present invention.

FIG. 7 is a timing chart of the printer according to the present invention. FIG. 7 plots time as the abscissa and transfer voltages as the ordinate. The leading end 15A of the print medium 15 passes the transfer point Pt at time t1 and the end of the top margin passes the transfer point Pt at time t2. The beginning of the toner image 19 arrives at the transfer point Pt shortly after time t3.

When the printing operation begins, the photoconductive drum 11 is driven into rotation and the PWM signal generator 24 (FIG. 2) generates the PWM signal SG1, which in turn is output to the high voltage power supply circuit 14 (FIG. 3). Then, the high voltage power supply circuit 14 outputs the output voltage Vo=V1 in accordance with the PWM signal SG1. The controller 10 receives the current detection signal SG2 from the detector 18 of the high voltage power supply circuit 14. The controller 10 monitors the current detection signal SG2 to control the duty cycle of the PWM signal SG1, thereby maintaining the output current Io supplied to the transfer roller 13 at a predetermined constant value, that is, the high voltage power supply circuit 14 operates in the CCC mode.

When the leading end 15A of the print medium 15 is pulled in between the photoconductive drum 11 and the transfer roller 13, an output current controlled in the CCC mode flows into the circuit including the transfer roller 13, photoconductive drum 11, and the print medium 15. After time t1, the output voltage Vo is increased since the resistance of the circuit increases due to the insertion of the print medium 15 between the photoconductive drum 11 and the transfer roller 13, thereby maintaining the transfer current at a constant, optimum value. Monitoring changes in output voltage Vo allows calculation of the resistance of the circuit at all times. In the present invention, the measurement of the total resistance of the circuit is achieved not at the end of the top margin but at time t3 just before the beginning of the toner image, so that the measurement is conducted after the transfer voltage has reached its stable value. Then, an optimum transfer voltage is calculated based on the measured resistance of the circuit, and the high voltage power supply circuit is controlled to output the optimum transfer voltage to the transfer roller 13.

The operation will be described which detects the beginning of the toner image 16 on the print medium 15.

Figure 8:
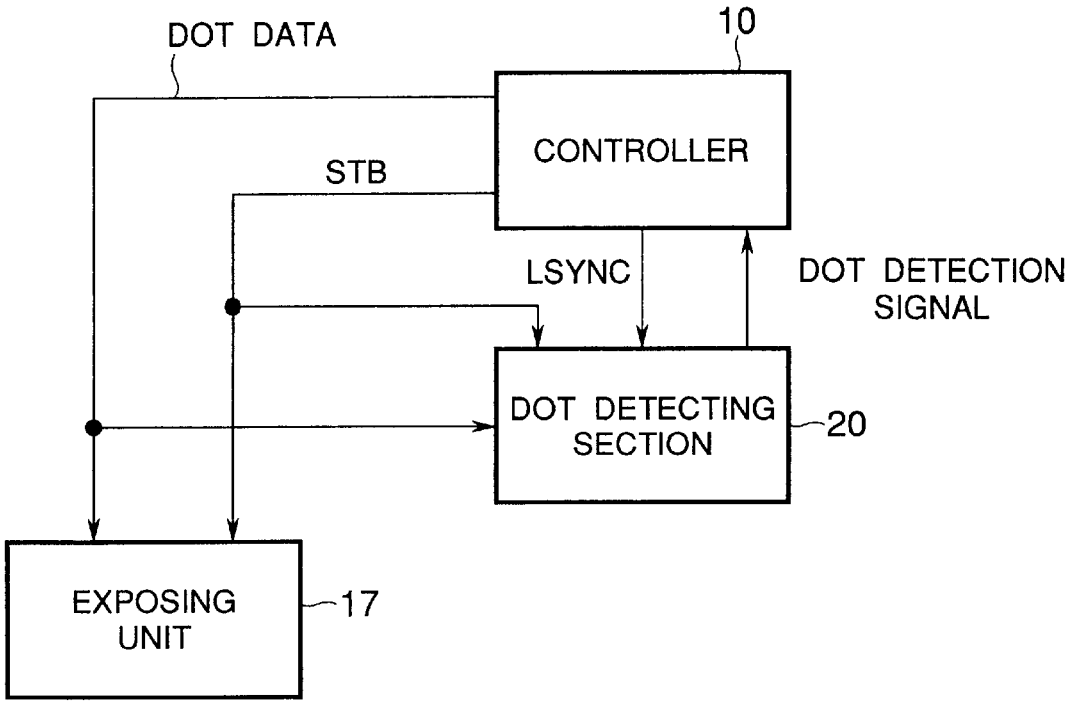
FIG. 8 is a block diagram showing a dot detecting section connected to the controller.

FIG. 8 is a block diagram showing a dot detecting section 20 connected to the controller 10. The controller 10 outputs dot data for one line to the exposing unit 17. The dot detecting section 20 is provided in the control logic 22 and detects a dot contained in the dot data. The dot detecting section 20 receives a strobe signal STB and an LSYNC from the controller 10. Every time the data for one line is output from the controller 10 to the exposing unit 17, the LSYNC is output immediately before the data for one line. The strobe signal STB is a timing signal for causing the exposing unit 17 to illuminate in accordance with the dot data for one line. The dot detecting section 20 outputs a dot detection signal if the section 20 detects at least one dot in the line.

The dot detecting section 20 begins to search the dot data for one line for a dot as soon as the LSYNC goes logic "1," i.e., when the transfer operation of the dot data is begun. If the dot data contains at least one dot, the dot data detecting section 20 outputs the dot detection signal to the controller 10 upon the logic level "1" of the strobe signal STB. The controller 10 calls for an interruption routine to determine a timing at which the resistance of the circuit should be measured.

Figure 9:
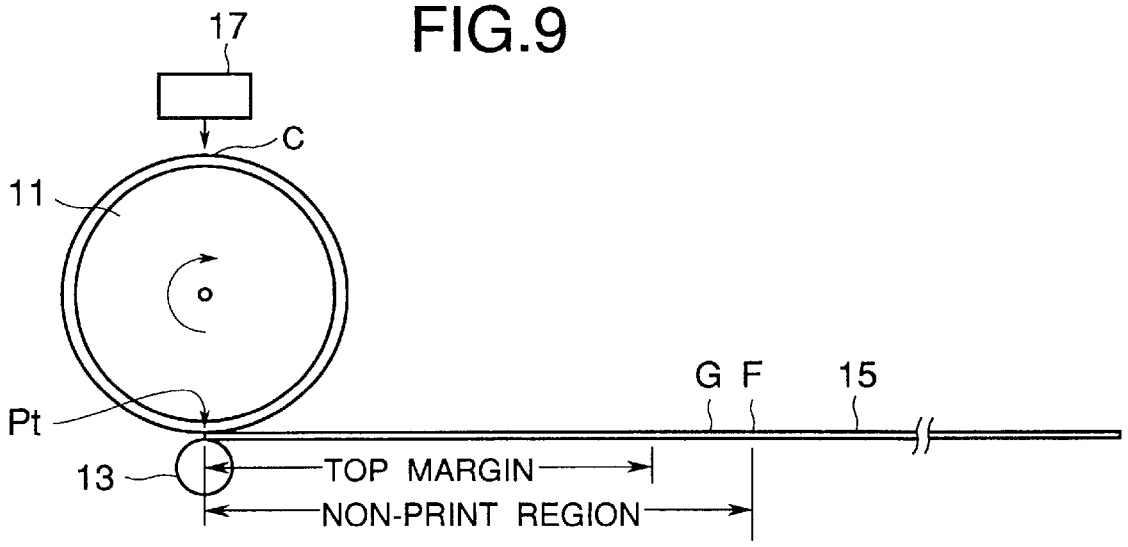
FIG. 9 illustrates the positional relationship between the photoconductive drum and the print medium being transported.

FIG. 9 illustrates the positional relationship between the photoconductive drum 11 and the print medium 15 being transported. The exposing unit 17 illuminates the photoconductive drum 11 at a point C. The leading end of the print medium 15 arrives at the transfer point Pt and moves into contact with the photoconductive drum 11. As the photoconductive drum 11 rotates, the print medium 15 travels leftward in FIG. 9 till the point C arrives at the transfer point Pt and moves into contact with the print medium 15 at a point F on the print medium. Therefore, the "non-print region" lies between the points Pt and F, and an actual transfer operation takes place at the point F.

No toner image is transferred to any part in the "non-print region" and therefore the measurement of the resistance of the circuit may be continued till a point G immediately before the point F arrives at the transfer point Pt. The distance from the leading end 15A to the point G is usually longer than the top margin, providing a longer measurement time than the prior art. This ensures that the resistance of the circuit is measured with the output current more stabilized.

Figure 10:
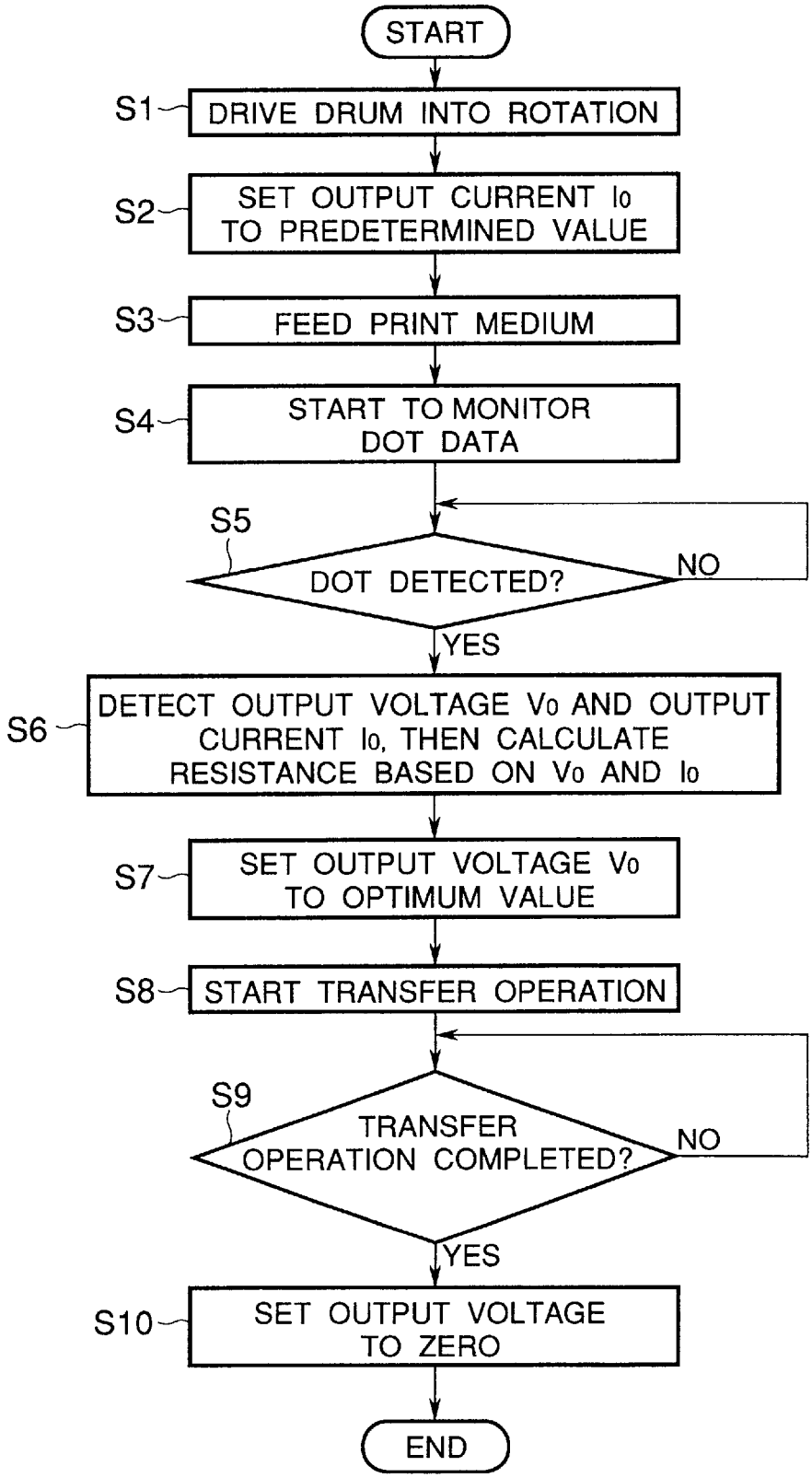
FIG. 10 is a flowchart illustrating the transfer of the toner image according to a first embodiment.

FIG. 10 is a flowchart illustrating the transfer of the toner image.

At step S1, the photoconductive drum 11 is driven into rotation. At step S2, the output current Io of the high voltage power supply circuit 14 is set to a predetermined value. Then, at step S3, the controller 10 causes the motor 40 to feed the print medium 15, and at step S4, the dot detecting section 20 begins to search the dot data for one line for a dot. At step S5, a check is made to determine whether the dot data contains a dot; if at least one dot is contained, then, the program proceeds to step S6 where the output voltage Vo and output current Io of the high voltage power supply circuit 14 are detected, and the resistance of the circuit including the photoconductive drum 11, print medium 15, and transfer roller 13 is calculated based on the detected values of Vo and Io. The step S6 is carried out during a period from time t1 to time t3 shown in FIG. 7. At step S7, the output voltage Vo to an optimum voltage in accordance with the resistance calculated at step S6. At step S8, the controller 10 performs the transfer operation. Upon completion of the transfer operation (step S9), the program proceeds to step SlO where the output voltage of the high voltage power supply circuit 14 is set to zero volts.

Second embodiment

When the electrophotographic printer is operated in the aforementioned manner, if the printing speed is increased and there is a dot near the top margin, then the resistance cannot be measured accurately for the same reason as in the conventional printer. However, as mentioned with reference to FIG. 3, the high voltage power supply circuit 14 outputs the signals SG3 and SG2 to the controller 10 at all times, so that the controller 10 can monitor these signals SG2 and SG3 continuously. In the second embodiment, the signals SG2 and SG3 are used to ensure accurate measurement of the resistance of the circuit including the photoconductive drum 11, transfer roller 13, and print medium 15.

If the dot data contains only characters and lines, then the density of toner deposited in the print region is very low and therefore the presence of the toner on the print medium 15 does not seriously affect the measurement of the resistance of the circuit even if the toner particles are present on the print medium 15 sandwiched between the transfer roller 13 and the photoconductive drum 11. For example, an initial value V1 of the output voltage Vo may be previously stored in the ROM 29. The transfer current may be measured while performing the actual transfer operation of a toner image at this initial transfer voltage. This way of measuring the transfer current makes it possible to measure the resistance of the circuit with a sufficient accuracy even after the actual transfer operation of toner image has been begun. Measuring the resistance of the circuit a plurality of times in this manner and averaging the measured values provides a substantially accurate value of the resistance of the print medium 15 which is traveling at a high speed. Such a measurement result does not seriously affect the print quality of the first page of print medium 15, and can be effectively used for the second page onward.

An electrophotographic printer is provided with a paper cassette which accommodates a plurality of pages of the print medium of the same kind. When printing operation takes place, the pages of print medium are fed one after the other from the cassette. In other words, pages of print medium of the same characteristics are used in a continuous printing and therefore the measured values of the resistance of the print medium do not vary significantly from page to page. For this reason, an average of the measured values of resistance is particularly useful and can be used to provide an optimum transfer voltage for the second page onward.

Figure 11:
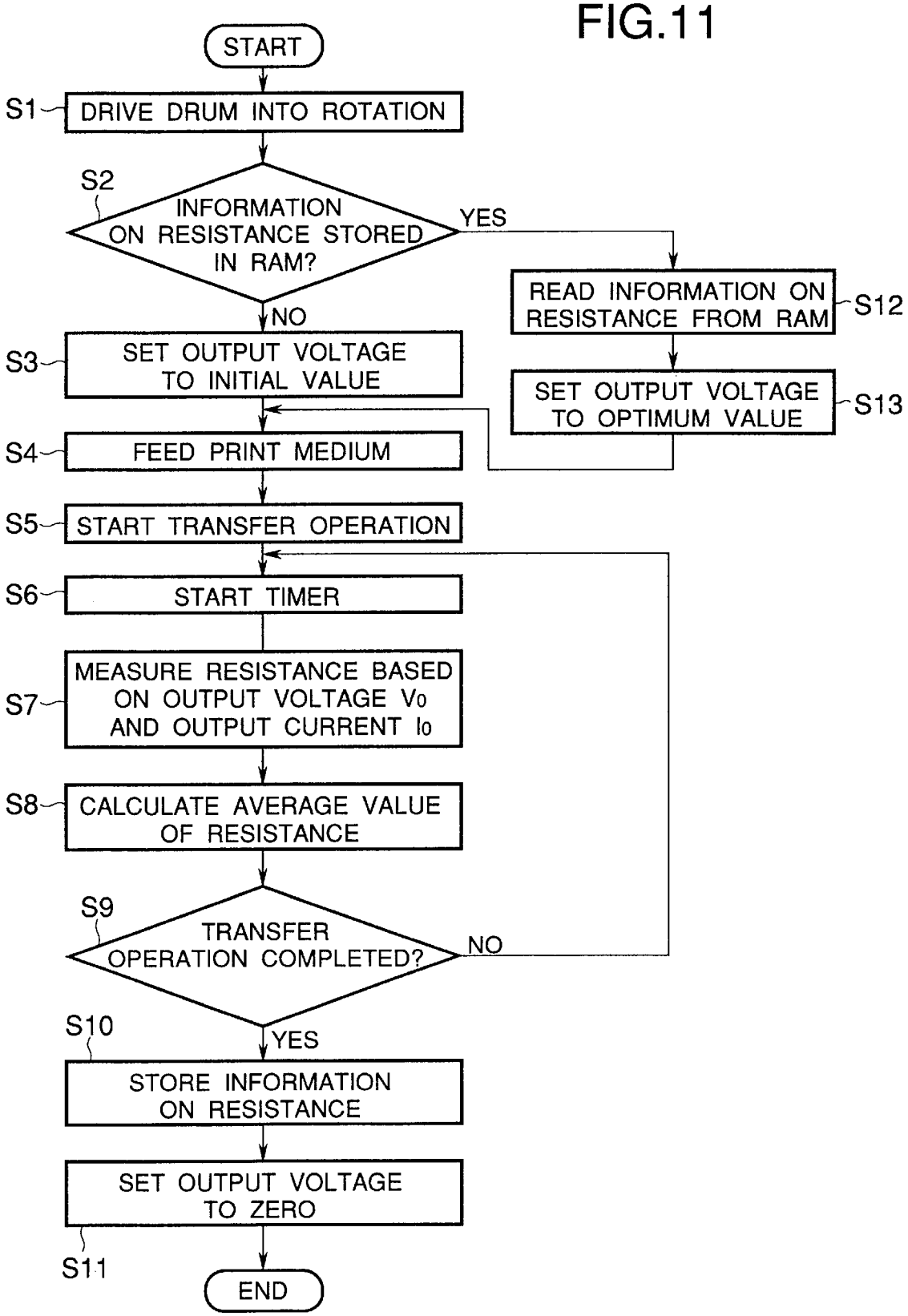
FIG. 11 is a flowchart illustrating the transfer operation according to a second embodiment.

FIG. 11 is a flowchart illustrating the transfer operation according to the second embodiment.

At step S1, the photoconductive drum 11 is driven into rotation. At step S2, a check is made to determine whether the RAM 32 contains information on the resistance of the circuit including the print medium 15. If the RAM 32 contains information on the resistance of the circuit including the transfer roller 13, print medium 15, and photoconductive drum 11, then the program proceeds to step 13. Initially, this information is not in the RAM 32, the program proceeds to step S3 where the value of the output voltage stored in the RAM 32 is set as an output voltage. At step S4, the first page of the print medium 15 is fed to the print engine. At step S5, the transfer operation is begun. At step S6, the controller starts to count time to generate timings, thereby periodically measuring the resistance of the circuit including the transfer roller 13, print medium 15, and photoconductive drum 11.

At step S7, the resistance is measured. At step S8, every time a new measured value of the resistance is obtained, an average value of the previously measured values is recalculated. At step S9, a check is made to determine whether the transfer operation has completed; if the answer is NO, then the program jumps back to step S6 to repeat steps S6–S9 till the transfer operation completes. If the transfer has completed at step S9, the program proceeds to step S10 where the average value of the measured values of the resistance is stored in the RAM 32. Then, the output voltage Vo of the high voltage power supply circuit 14 is set to zero volts. The average value of resistance stored in the RAM 32 is used to set a transfer voltage for the second page onward.

When the printing operation of the second page has begun, it is determined at step S2 that the RAM 32 contains the information on the resistance of the circuit including the print medium 15, and therefore the program proceeds to step S12 where the controller 10 reads the information from the RAM 32. At step S13, the output voltage Vo of the high voltage power supply circuit 14 is set to an optimum value. In this manner, the information resulting from the transfer operation of the first page can be used to optimize the transfer voltage for the second page onward.

Third embodiment

If the dot data contains only characters and lines, the density of toner deposited in the print region of the print medium 15 is low and therefore the resistance of the toner does not seriously affect the resistance of the circuit including the transfer roller 13, print medium 15, and photoconductive drum 11. However, graphic images, for example, may well involve extremely high density portions in the same page, so that the resistance of toner cannot be neglected.

Figure 12:
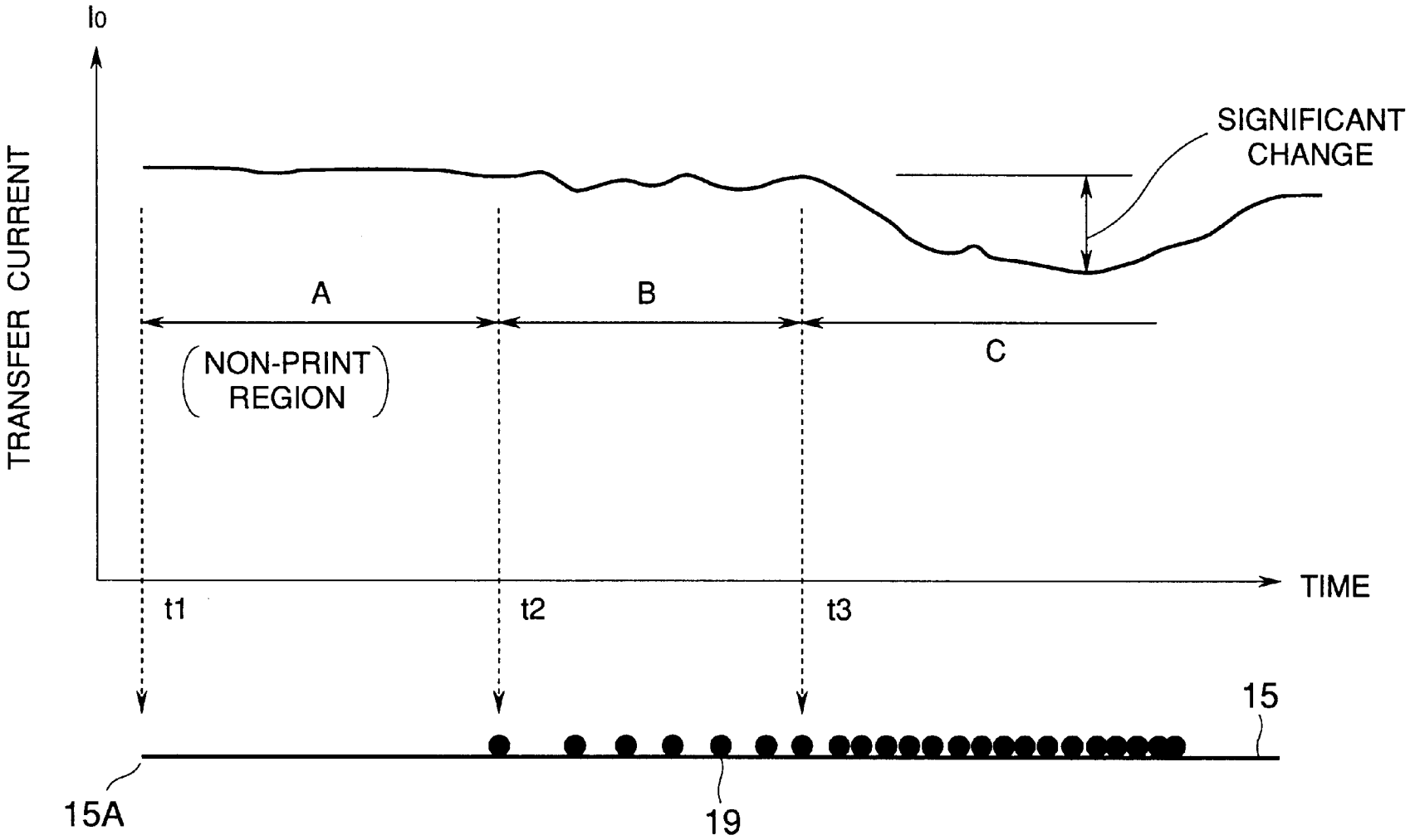
FIG. 12 shows changes in transfer current during the transfer operation.

FIG. 12 shows changes in transfer current during the transfer operation. FIG. 12 plots time as the abscissa and transfer currents as the ordinate. The leading end 15A of the print medium 15 passes the transfer point Pt at time t1 and the forward end of the print region (region B) in which the toner is deposited passes the transfer point Pt at time t2. The forward end of the high density region (region C) passes the transfer point Pt at time t3.

In region A, the load on the transfer voltage is a circuit including the transfer roller 13, the non-print region of the print medium 15, and the photoconductive drum 11, and is of a substantially constant value. In region B, the print medium 15 includes characters and lines printed thereon and has a relatively low density of toner. The resistance of the circuit is therefore negligible and changes in transfer current is not significant.

In region C, the resistance of region C is high due to a large amount of toner deposited on the print medium 15 and the transfer current becomes prominently small, making it difficult to accurately measure the resistance of the print medium 15. Thus, if a difference between a new measured transfer current and an average of the previously measured transfer currents falls outside of a predetermined range, then the new measured value is simply discarded. In this manner, the resistance of the print medium 15 can be accurately measured during the transfer operation even if the toner image contains some areas in which toner density is very high.

Figure 13:
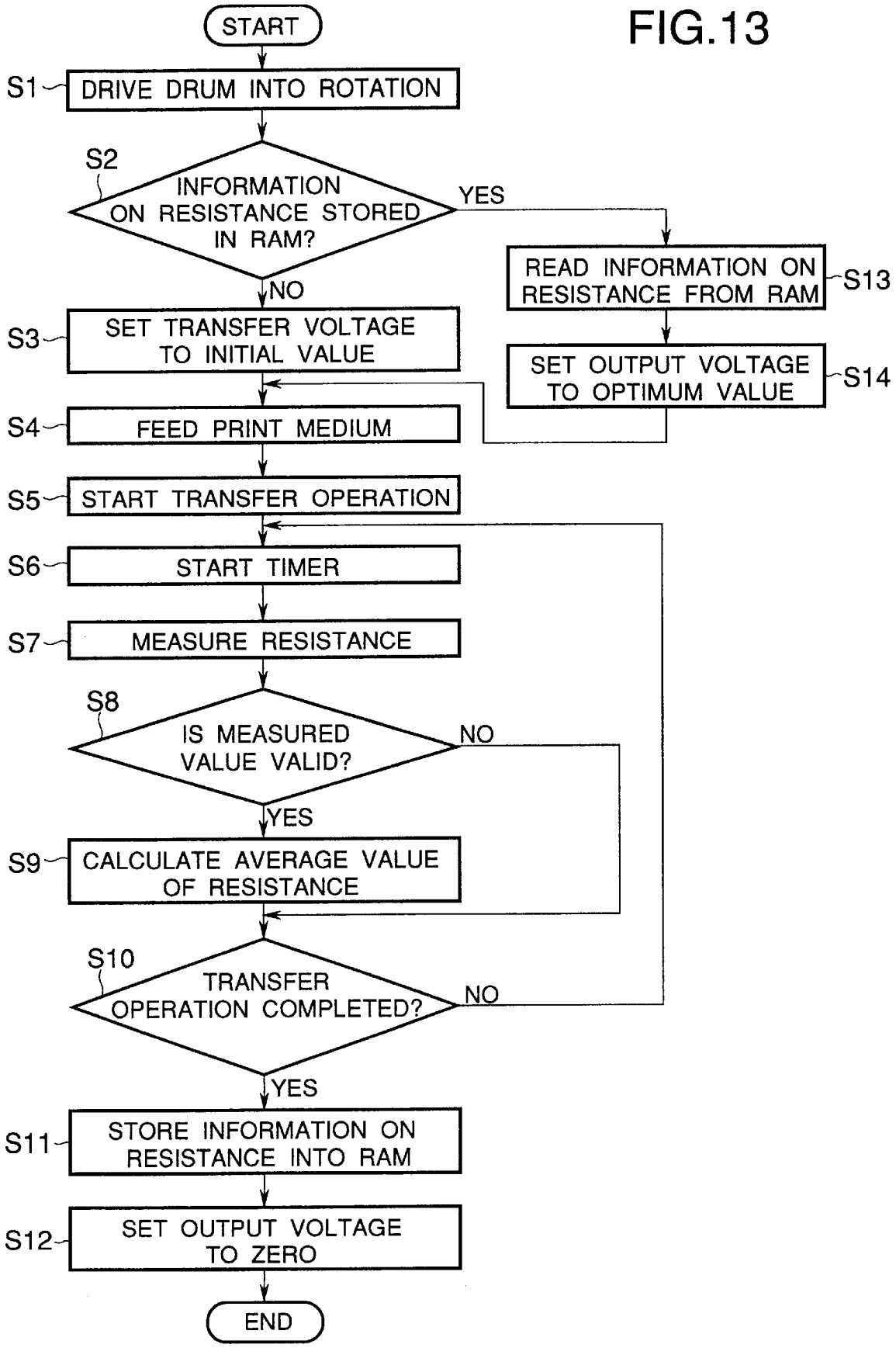
FIG. 13 is a flowchart illustrating the transfer operation of a third embodiment.

FIG. 13 is a flowchart illustrating the transfer operation of the third embodiment.

Steps S1–S6 are the same as those in the second embodiment.

At step S8, a check is made to determine whether the measured resistance is valid or not. That is, the resistance value measured is compared with the resistance values previously measured. If a difference between the resistance value measured at step S7 and the previously measured resistance values falls outside of a predetermined range, the resistance value measured at step S7 is simply discarded. Then, the program proceeds to step S10 where a check is made to determine whether the transfer operation of the toner image has completed. If the answer is NO at step S10, then the program jumps back to step S6 to perform the next sequence of measuring the resistance. If the answer is YES at step S10, the program proceeds to step S9 where an average of the resistance values is calculated. At step S11, the average value is stored into the RAM 32. A substantially accurate value of resistance can be calculated by carrying out the aforementioned steps, thereby optimizing the transfer voltage.

Fourth embodiment

In both the second and third embodiments, the resistance is measured with the toner present between the photoconductive drum 11 and the transfer roller 13. However, if there are many areas on a page of the print medium 15 in which toner is absent, such areas may be effectively used to measure the resistance of the circuit. A fourth embodiment is to implement a method of measuring the resistance of the circuit in such a circumstance.

The controller 10 receives the dot detection signal from the dot detecting section 20, thereby determining "toner-absent areas" on the print medium 15 in which there is not a dot. The areas are detected in the same manner previously described with reference to FIGS. 8 and 9. The controller has a line counter that counts the number of lines in which a dot is absent. If the dot is absent over a number of lines in excess of a predetermined number, that is, if the exposing unit 17 does not illuminate the photoconductive drum 11 longer than a predetermined length of time, then the resistance of the circuit including the photoconductive drum 11, transfer roller 13, and print medium 15 is measured during the predetermined length of time. This way of measuring the resistance eliminates the adverse effect of the toner resistance, allowing accurate measurement of the resistance of the circuit.

Figure 14:
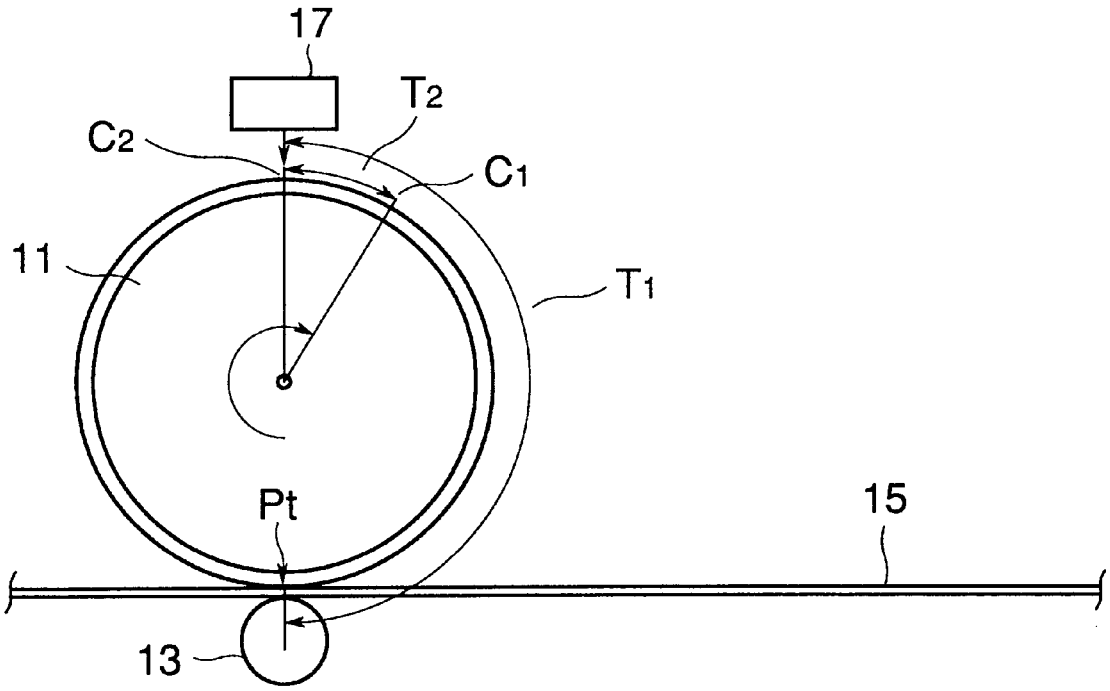
FIG. 14 illustrates the positional relationship between the "toner-absent area" on the photoconductive drum and the print medium being transported.

FIG. 14 illustrates the positional relationship between the "toner-absent area" on the photoconductive drum 11 and the print medium 15 being transported.

Referring to FIG. 14, the exposing unit 17 does not illuminates the photoconductive drum 11 in an area from point C1 to point C2 for a length of time T2. The point C1 will arrive at the transfer point Pt a time T1-T2 after the exposing unit 17 resumes to illuminate the photoconductive drum 11 at the point C2, and subsequently the controller 10 calculates the resistance of the circuit while the "toner-absent area" between the points C1 and C2 passes the transfer point Pt.

Figure 15:
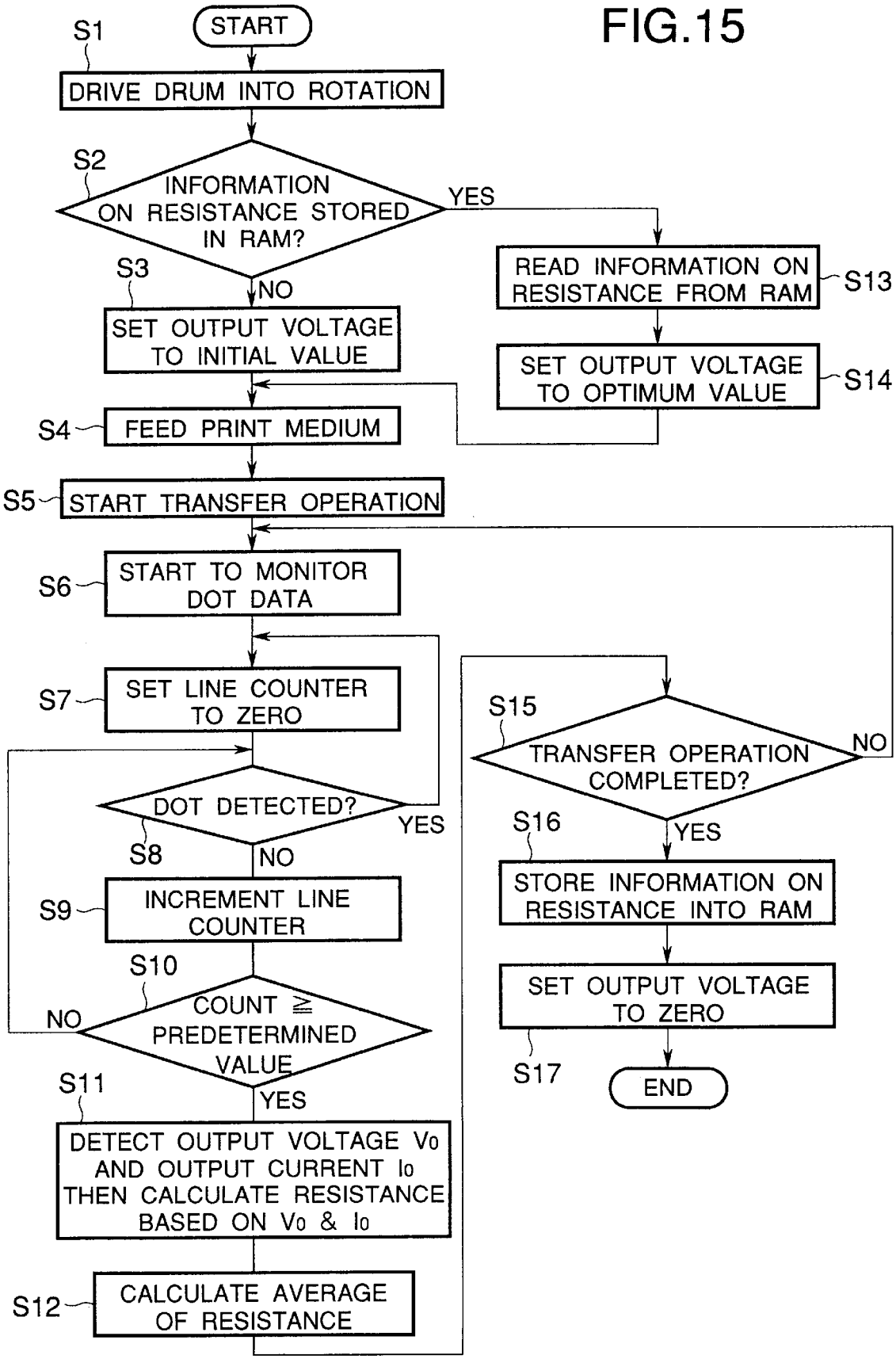
FIG. 15 is a flowchart illustrating the method of measuring the resistance of the circuit, according to the fourth embodiment.

FIG. 15 is a flowchart illustrating the method of measuring the resistance of the circuit according to the fourth embodiment.

Steps S1–S5 are the same as those in the third embodiment. At step S6, the controller 10 starts to monitor the dot detection signal output from the dot detecting section 20 to detect dots. At step S7, a line counter is set to zero. At step S8, a check is made to determine whether the dot data for one line contains a dot; if the answer is YES, the program jumps back to step S7, if the answer is NO, then the program proceeds to step S9 where the line counter is incremented. At step S10, a check is made to determine whether the content of the line counter is equal to or grater than a predetermined value; if the answer is NO, the program jumps back to step S8, if the answer is YES, then the program proceed to step S11 where a resistance is calculated based on the output voltage Vo and output current Io detected by the detector 18 at that time. In this manner, if there is no dot in lines more than a predetermined number, then the resistance is calculated based on the output voltage Vo (SG3) and output current Io (SG2) when an area on the photoconductive drum 11 defined by the lines reaches the transfer point Pt.

At step S9, an average of the measured resistance values is calculated. At step S10, a check is made to determine whether the transfer operation has completed. Steps S13–S14 and S15–S17 are the same as the steps S13–S14 and S10–S12, respectively, of the third embodiment.

In many cases, print medium 15 has areas on the print medium 15 in which toner is absent, and such areas may often be larger than the top margin. Therefore, the resistance can be measured whenever such areas are found in the dot data.

In the first to fourth embodiments, if the print medium 15 travels at such a speed that the resistance can be accurately measured when the top margin of the print medium 15 is passing the transfer point Pt, an optimum output voltage of the high voltage power supply circuit 14 can be set on the basis of the measured resistance just as in the prior art.

If the printer has a plurality of paper cassettes and different kinds of print medium are selectively fed to the print engines, it is desirable that the resistances are supervised on a paper cassette basis.

While the dot data supplied to the exposing unit 17 is monitored to detect dots, the dots may be detected by directly analyzing the print data supplied from the host apparatus to the printer. This alternative way is particularly useful if the dot data is produced on the host apparatus side. The transfer roller 13 can be replaced by other transfer means such as a transfer wire or the like.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrophotographic recording apparatus comprising:

a photoconductive drum on which a toner image is formed in accordance with dot data, said photoconductive drum rotating in a first direction;

a transfer roller, rotating in a second direction opposite to the first direction, said transfer roller transferring the toner image from said photoconductive drum to a print medium when the print medium passes a transfer point where the print medium is sandwiched between said transfer roller and said photoconductive drum;

a high voltage power supply circuit, applying a transfer voltage to said transfer roller; and a controller having a resistance measuring section which makes a plurality of measurements of electrical resistance values of a circuit including said transfer roller, print medium, and photoconductive drum, said resistance measuring section measuring the electrical resistance of the circuit at predetermined intervals during a time period when said high voltage power supply circuit begins to output a transfer voltage of a predetermined value to said transfer roller until said high voltage power supply circuit stops outputting the transfer voltage, said controller adjusting the transfer voltage to an optimum value in accordance with an average value of the electrical resistance of the circuit;

wherein said controller stores an average value of the electrical resistance values of a preceding page of consecutive pages of print medium into a memory, reads the average value from the memory immediately before a transfer operation for a following page of the consecutive pages of print medium, and causes said high voltage power supply circuit to output the transfer voltage in accordance with the average value when the toner image is transferred from said photoconductive drum to the following page of print medium.

2. The electrophotographic recording apparatus according to claim 1, wherein said controller discards a resistance value if a difference between the resistance value and an average value of preceding resistance values falls outside of a predetermined range.

3. An electrophotographic recording apparatus comprising:

a rotating photoconductive drum on which a toner image is formed in accordance with dot data;

a transfer roller, rotating in contact with said photoconductive drum, said transfer roller transferring the toner image from said photoconductive drum to a print medium when the print medium passes a transfer point where the print medium is sandwiched between said transfer roller and said photoconductive drum;

a high voltage power supply circuit, applying a transfer voltage to said transfer roller; and a controller having a resistance measuring section which measures an electrical resistance of a circuit including said transfer roller, print medium, and photoconductive drum, said controller detecting a location of the toner image on said photoconductive drum so as to determine a non-print region on the print medium, said resistance measuring section measuring the electrical resistance of the circuit if the non-print region is greater than a predetermined size, said controller optimizing the transfer voltage in accordance with the resistance of the circuit.

* * * * *